US006025594A

United States Patent [19]

Bryce et al.

[11] Patent Number: 6,025,594

[45] Date of Patent: Feb. 15, 2000

[54] SUPPORT MOUNTING FOR A PIN ARRAY CORONA GENERATING DEVICE

[75] Inventors: James R. Bryce, Livingston, Tex.; Michael J. Mentus, Spencerport, N.Y.

[73] Assignee: Xerox Corporation, Stamford, Conn.

[21] Appl. No.: 09/003,696

[22] Filed: Jan. 7, 1998

[51] Int. Cl.[7] ..... H01T 19/04; G03G 15/02

[52] U.S. Cl. ..... 250/324; 250/325; 250/326; 399/170

[58] Field of Search ..... 250/324, 325, 250/326; 399/170

[56] References Cited

U.S. PATENT DOCUMENTS

| | | | |
|---|---|---|---|
| 3,691,373 | 9/1972 | Compton | 250/49.5 |
| 4,110,811 | 8/1978 | Hubble, III et al. | 361/225 |
| 4,725,732 | 2/1988 | Lang et al. | 250/326 |
| 5,257,073 | 10/1993 | Gross et al. | 355/221 |
| 5,324,941 | 6/1994 | Gross et al. | 250/324 |

*Primary Examiner*—Edward P. Westin
*Assistant Examiner*—Nikita Wells
*Attorney, Agent, or Firm*—D. A. Robitaille

[57] ABSTRACT

A support mounting supports the corona generating electrode of a corona generating device. A corona generating assembly includes a corona generating electrode member having an elongated length defining a plurality of support openings spaced along the length of the corona generating electrode member, a primary support member having integral, outwardly extending support projections for supporting the corona generating electrode member, with the integral support projections arranged on the primary support member at positions corresponding to the support openings formed in the corona generating electrode member for cooperative engagement therewith, and a secondary support member adapted to define support projection receiving openings corresponding to the support projections of the primary support member for interlocking engagement therewith, such that said corona generating electrode member is sandwiched between the primary support member and the secondary support member.

12 Claims, 5 Drawing Sheets

SUPPORT MOUNTING FOR A PIN ARRAY CORONA GENERATING DEVICE

The present invention relates generally to corona charging devices, and more particularly concerns a support mounting for supporting a pin array corona generating electrode in a corona generating device of the type utilized in electrostatographic copying and printing machines.

Generally, the process of electrostatographic copying is executed by exposing a light image of an original document to a substantially uniformly charged photoreceptive member. Exposing the charged photoreceptive member to a light image discharges the photoconductive surface thereof in areas corresponding to non-image areas in the original document, while maintaining the charge on image areas to create an electrostatic latent image of the original document on the photoreceptive member. The electrostatic latent image is subsequently developed into a visible image by a process in which a charged developing material is deposited onto the photoconductive surface of the photoreceptor such that the developing material is attracted to the image areas thereon. The developing material is then transferred from the photoreceptive member to a copy sheet on which the image may be permanently affixed to provide a reproduction of the original document. In a final step, the photoconductive surface of the photoreceptive member is cleaned to remove any residual developing material therefrom in preparation for successive imaging cycles.

The described process is well known and is useful for light lens copying from an original, as well as for printing documents from electronically generated or stored originals. Analogous processes also exist in other electrostatographic applications such as, for example, digital printing applications wherein the latent image is generated by a modulated laser beam.

In electrostatographic applications, it is common practice to use corona generating devices for providing electrostatic fields to drive various machine operations. Such corona devices are primarily used to deposit charge on the photoreceptive member prior to exposure to the light image for subsequently enabling toner transfer thereto. In addition, corona devices are used in the transfer of an electrostatic toner image from a photoreceptor to a transfer substrate, in tacking and detacking paper to or from the imaging member by applying a neutralizing charge to the paper, and, generally, in conditioning the imaging surface prior to, during, and after toner is deposited thereon to improve the quality of the xerographic output copy. Because a relatively large number of corona generating charging devices are required to accomplish the many various operations in a single electrostatographic machine, a minor improvement or reduction in unit cost may reap substantial benefits, particularly in light of the operation life of the unit and replacement cycles in a machine.

The conventional form of corona generating charging device used in electrostatographic reproduction systems is generally shown in U.S. Pat. No. 2,836,725. That patent discloses a basic corotron device wherein a conductive corona generating electrode in the form of an elongated wire is partially surrounded by a conductive shield. The corona generating electrode, or so called coronode, is provided with a relatively high DC voltage to cause ionization of the air immediately surrounding the coronode, while the conductive shield is usually electrically grounded to direct the ions toward the surface to be charged. Alternatively, the corotron device may be biased in a manner taught in U.S. Pat. No. 2,879,395, which describes a device known as a scorotron, wherein an AC corona generating potential is applied to the conductive wire electrode while a DC biasing potential is applied to a conductive shield partially surrounding the electrode. This DC potential regulates the flow of ions from the electrode to the surface to be charged so that the charge rate can be adjusted, making this biasing system ideal for self-regulating systems. Countless other charging and biasing arrangements are known in the art and will not be discussed in great detail herein.

In one type of charging device of particular interest with respect to the present invention, a charging electrode may be provided in the form of an electrically conductive strip having projections, scalloped portions, or teeth members integrally formed with, and extending from, a longitudinal edge of the electrode. This arrangement, known as a pin array electrode, provides significant structural and operational advantages over other types of electrode devices such as thin wire electrodes, including comparatively high structural strength, greater charge uniformity, and reduced levels of undesirable ozone emissions. U.S. Pat. No. 3,691,373 to Compton et al. demonstrates a corona generating device generally comprising a pin array electrode supported on either side by support strips, and mounted within an electrically nonconductive base member. The electrode is fixed into position within the base member by means of a plurality of transverse pins and associated nuts or other fasteners, wherein the pins fit through matching holes in the base member, the pin array, and the support strips. The corona generating device disclosed therein may further include a screen and/or an auxiliary electrode as well as various additional conductive shields for regulating charging current to control uniformity of charge. A detailed description and illustration of pin array corona generating devices, specifically describing the mounting mechanism used to support a pin array electrode in a corotron device is provided in U.S. Pat. Nos. 4,725,732 and 4,792,680, among numerous other patents and publications.

Generally, it is important that the pin array electrode, which is typically stretched between mountings at opposite ends of the corona generating device, is maintained under tension so as to be in a taut condition. Any looseness and/or kinks in the electrode member may result in a non-uniform charge derived from the corona generating device. In order to insure that the electrode member is sufficiently supported, the pin array electrode is conventionally mounted between support members, as shown in previously referenced U.S. Pat. Nos. 4,725,732 and 4,792,680.

It is also desirable to provide an arrangement for easily replacing faulty or a deteriorated corona generating electrode upon failure, or preferably, for replacing a corona generating electrode prior to failure through preventative maintenance. Typically, the replacement of a pin array electrode necessitates replacement of the entire assembly of the corona generating device, creating waste and additional expense. For example, in the previously referenced devices of U.S. Pat. Nos. 4,725,732 and 4,792,680, removal of the nuts or other fasteners from the associated support pins usually requires brute force of the level that results in breakage and destruction of the entire corona generating assembly. Since replacement is usually handled by a service technician at the commercial site at which the machine is located, ease of replacement and adjustment in a minimum amount of time is essential. Thus, it is an object of the present invention to provide a pin array corona generating device that is cost effective and serviceable while eliminating waste by permitting the replacement and/or adjustment of the corona generating electrode within a corona generating device.

The following disclosures may be relevant to various aspects of the present invention:

U.S. Pat. No. 3,691,373

Patentee: Compton et al.

Issued: Sep. 12, 1972

U.S. Pat. No. 4,110,811

Patentee: Hubble III et al.

Issued: Aug. 29, 1978

U.S. Pat. No. 4,725,732

Patentee: Lang et al.

Issued: Feb. 16, 1988

U.S. Pat. No. 5,324,941

Patentee: Gross et al.

Issued: Jun. 28, 1994

The relevant portions of the foregoing disclosures may be briefly summarized as follows:

U.S. Pat. No. 3,691,373 discloses a corona charging device comprising an electrically nonconductive base member having a pin array type corona generating member mounted in the central slot thereof. The corona generating member comprises an electrically conductive central strip having a number of projections along the top edge, being supported by a pair of side strips positioned on either side. The corona generating member is held together and fastened to the nonconductive base member by a number of transverse pins fitted into matching holes in the central and side strips.

U.S. Pat. No. 4,110,811 discloses a corona generating device including a corona generating electrode in the form of a wire supported between insulating end block assemblies. Each assembly is constructed of mating half-sections which jointly define a substantially closed and insulated cavity lined with a conductive insert, wherein the electrode is held taut by means of a loaded compression spring carried within the insert on one half-section, the spring bearing against a conductive insert on the end and against a second conductive bead varied by the other end of the electrode.

U.S. Pat. No. 4,725,732 discloses a corona device comprising either a corotron or a scorotron for charging a surface, comprised of at least first and second complementary, interlocking pin array support members, at least one pin array member having integral pin projections and a power source extension member for connection to a high voltage power supply supported on and between the pin array support members, and a shield or screen member connected to a relatively low voltage, and supported externally on at least one of the pin array support members spaced from the pin array.

U.S. Pat. No. 5,324,941 discloses a tension support mounting for applying tension to a corona generating electrode of a corona generating device. Various embodiments are described wherein the corona generating electrode is fastened to a mounting block including an electrode support member, the position of which can be varied for applying variable tension to the corona generating electrode.

In accordance with one aspect of the present invention, a corona generating assembly is provided, comprising: a corona generating electrode member having an elongated length defining a plurality of support openings formed therein, and spaced along the length of the corona generating electrode member; a primary support member having integral support projections extending outwardly therefrom for supporting the corona generating electrode member, wherein the integral support projections are arranged on the primary support member at positions corresponding to the support openings formed in the corona generating electrode member for cooperative engagement therewith; and a secondary support member adapted to define support projection receiving openings corresponding to the support projections of the primary support member for interlocking engagement therewith, such that the corona generating electrode member is sandwiched between the primary support member and the secondary support member.

In accordance with another aspect of the present invention a electrostatographic printing apparatus is provided, including a corona generating assembly, comprising: a corona generating electrode member having an elongated length defining a plurality of support openings formed therein, and spaced along the length of the corona generating electrode member; a primary support member having integral support projections extending outwardly therefrom for supporting the corona generating electrode member, wherein the integral support projections are arranged on the primary support member at positions corresponding to the support openings formed in the corona generating electrode member for cooperative engagement therewith; and a secondary support member adapted to define support projection receiving openings corresponding to the support projections of the primary support member for interlocking engagement therewith, such that the corona generating electrode member is sandwiched between the primary support member and the secondary support member.

These and other aspects of the present invention will become apparent from the following description conjunction with the accompanying drawings, in which.

For a general understanding of the features of the present invention, reference is made to the drawings. While the present invention will be described in terms of one particular embodiment, it will be understood that the invention is not to be limited to this embodiment. On the contrary, the present invention is intended to cover all alternatives, modifications, and equivalents as may be included within the spirit and scope of the invention as defined by the appended claims.

Figure 5:
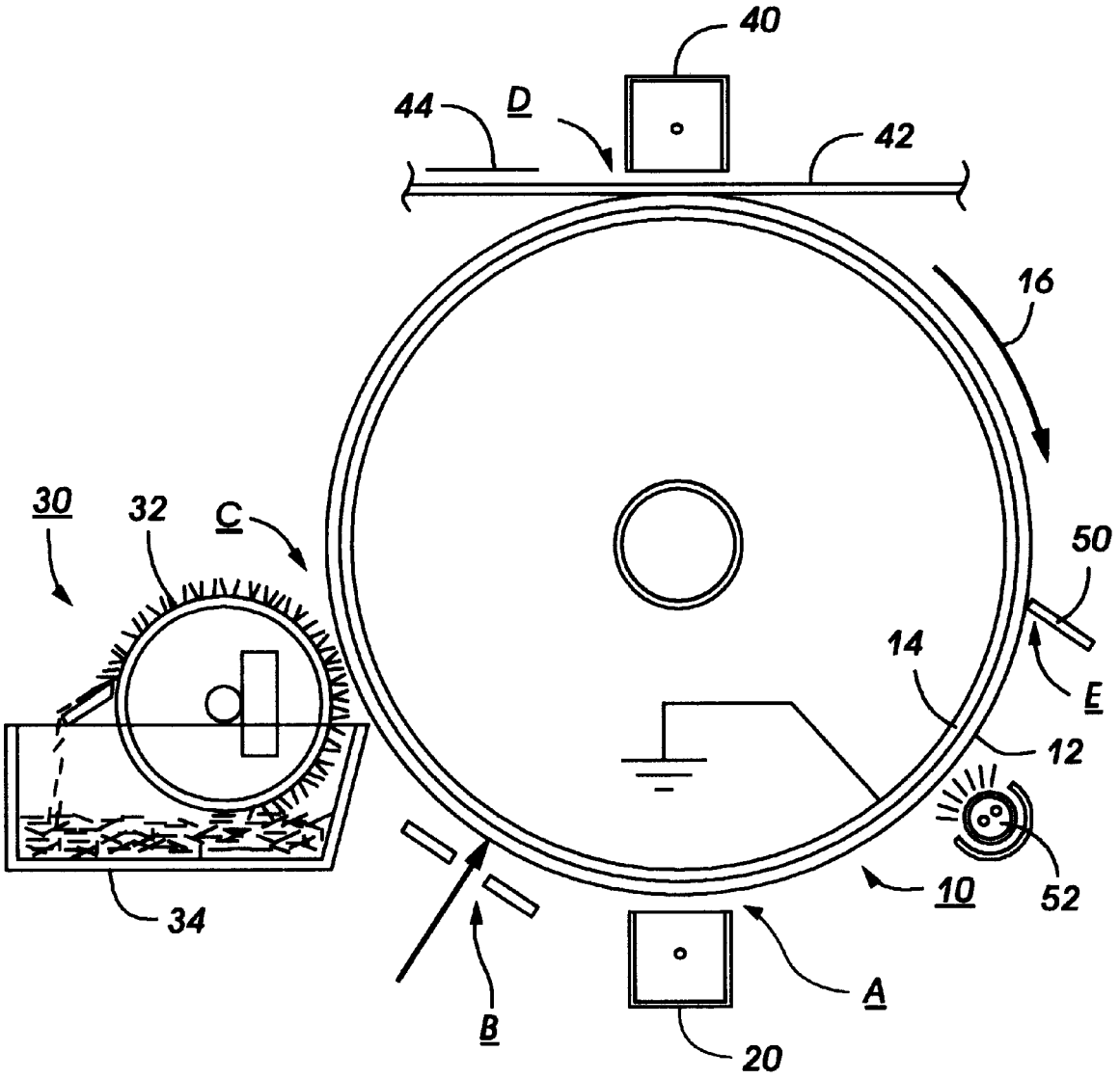
FIG. 5 is a schematic view showing an electrophotographic copying apparatus employing at least one corona generating device in accordance with the present invention.

Referring initially to FIG. 5, prior to describing the specific features of the present invention, a schematic depiction of the various components of an exemplary electrophotographic reproducing apparatus incorporating the corona generating assembly of the present invention is provided. Although the apparatus of the present invention is particularly well adapted for use in an electrophotographic reproducing machine, it will become apparent from the following discussion that the present corona generating device is equally well suited for use in a wide variety of electrostatographic processing machines as well as other systems requiring the use of a corona generating device. In particular, it should be noted that the corona generating device of the present invention, described hereinafter with reference to an exemplary charging system, may also be used in the toner transfer, detack, or cleaning subsystems of a typical electrostatographic copying or printing apparatus since such subsystems also require the use of a corona generating device.

The exemplary electrophotographic reproducing apparatus of FIG. 5 employs a drum 10 including a photoconductive surface 12 deposited on an electrically grounded conductive substrate 14. A motor (not shown) engages with drum 10 for rotating the drum 10 in the direction of arrow 16 to advance successive portions of photoconductive surface 12 through various processing stations disposed about the path of movement thereof, as will be described.

Initially, a portion of drum 10 passes through charging station A. At charging station A, a charging device, preferably of the type disclosed by the present invention, indicated generally by reference numeral 20, applies a charge to the photoconductive surface 12 on drum 10, to produce a relatively high, substantially uniform potential thereon. The charging device in accordance with the present invention will be described in detail following the instant discussion of the electrostatographic apparatus and process.

Once charged, the photoconductive surface 12 is advanced to imaging station B where an original document (not shown) may be exposed to a light source (also not shown) for forming a light image of the original document onto the charged portion of photoconductive surface 12 to selectively dissipate the charge thereon, thereby recording onto drum 10 an electrostatic latent image corresponding to the original document. One skilled in the art will appreciate that various methods may be utilized to irradiate the charged portion of the photoconductive surface 12 for recording the latent image thereon as, for example, a properly modulated scanning beam such as a laser beam.

After the electrostatic latent image is recorded on photoconductive surface 12, drum 10 is advanced to development station C where a development system, such as a so-called magnetic brush developer, indicated generally by the reference numeral 30, deposits developing material onto the electrostatic latent image. The exemplary magnetic brush development system 20 includes a single developer roller 32 disposed in developer housing 34, in which toner particles are mixed with carrier beads to create an electrostatic charge therebetween, causing the toner particles to cling to the carrier beads and form developing material The developer roll 32 rotates to form a magnetic brush having carrier beads and toner particles magnetically attached thereto. As the magnetic brush rotates, developing material is brought into contact with the photoconductive surface 12 such that the latent image therefrom attracts the toner particles of the developing material, forming a developed toner image on the photoconductive surface 12. It will be understood by those skilled in the art that numerous types of development systems could be substituted for the magnetic brush development system shown herein.

After the toner particles have been deposited onto the electrostatic latent image for development thereof, drum 10 advances the developed image to transfer station D, where a sheet of support material 42 is moved into contact with the developed toner image in a timed sequence so that the developed image on the photoconductive surface 12 contacts the advancing sheet of support material 42 at transfer station D. A charging device 40 is provided for creating an electrostatic charge on the backside of sheet 42 to aid in inducing the transfer of toner from the developed image on photoconductive surface 12 to the support substrate 42. While a conventional coronode device is shown as a charge generating device 40, it will be understood that the ionically conductive liquid charging device of the present invention might be substituted for the corona generating device 40 for providing the electrostatic charge which induces toner transfer to the support substrate materials 42. However, it will be recognized after image transfer to the substrate 42, the support material 42 is subsequently transported in the direction of arrow 44 for placement onto a conveyor (not shown) which advances the sheet to a fusing station (also not shown) which permanently affixes the transferred image to the support material 42 thereby for a copy or print for subsequent removal of the finished copy by an operator.

Often, after the support material 42 is separated from the photoconductive surface 12 of drum 10, some residual developing material remains adhered to the photoconductive surface 12. Thus, a final processing station, namely cleaning station E, is provided for removing residual toner particles from photoconductive surface 12 subsequent to separation of the support material 42 from drum 10. Cleaning station E can include various mechanisms, such as a simple blade 50, as shown, or a rotatably mounted fibrous brush (not shown) for physical engagement with photoconductive surface 12 to remove toner particles therefrom. Cleaning station E may also include a discharge lamp (not shown) for flooding the photoconductive surface 12 with light in order to dissipate any residual electrostatic charge remaining thereon in preparation for a subsequent imaging cycle.

The foregoing description should be sufficient for purposes of the present application for patent to illustrate the general operation of an electrostatographic reproducing apparatus incorporating the features of the present invention. As described, an electrostatographic reproducing apparatus may take the form of several well known devices of systems. Variations of the specific electrosatographic processing subsystems or processes described herein may be expected without affecting the operation of the present invention. For example, to those skilled in the art, the photoconductive coating of the photoreceptor may be placed on a flexible belt of either seamed or unseamed construction, continuous or not, without affecting the operation of the present invention.

Figure 1:
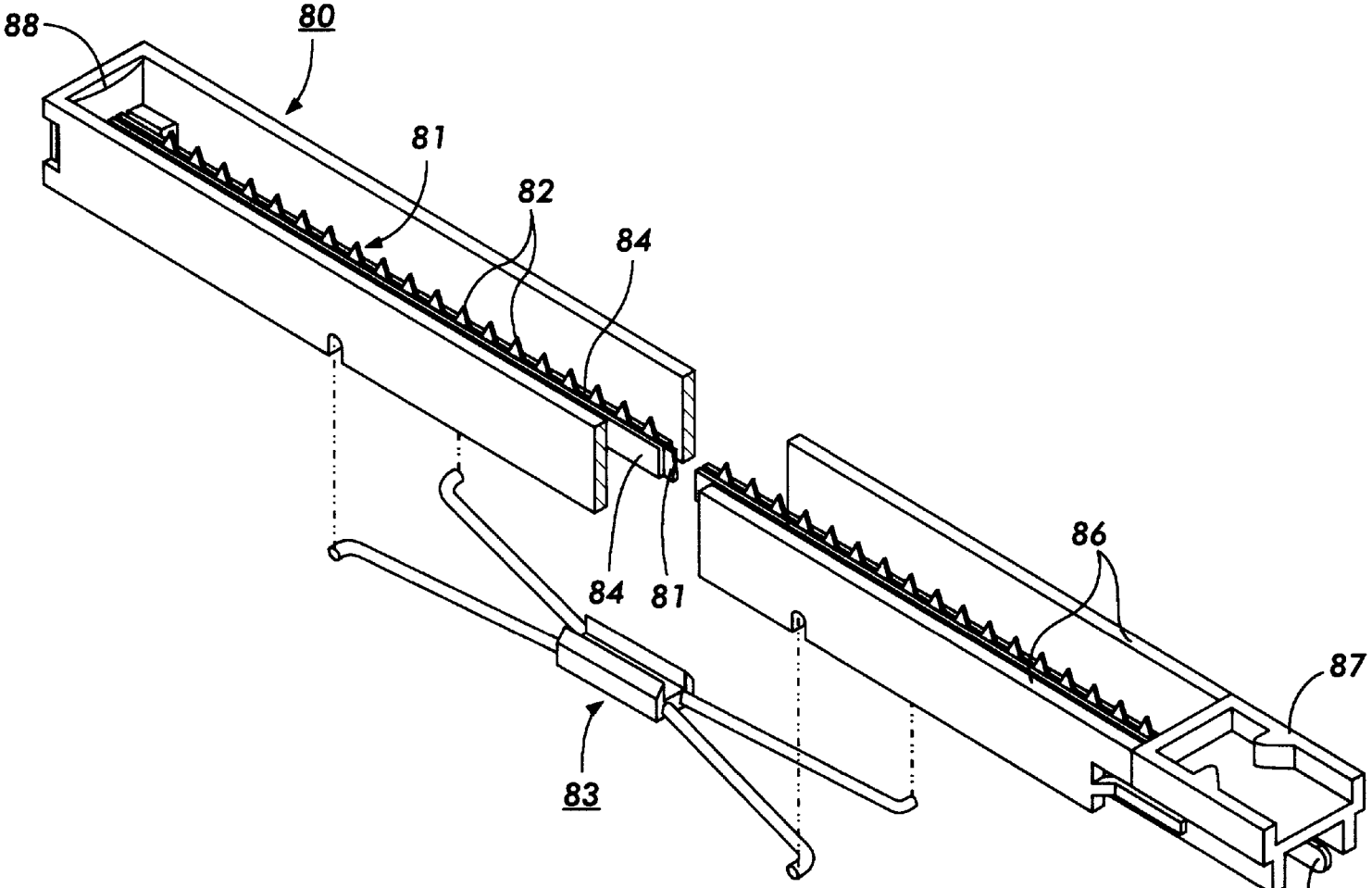
FIG. 1 PRIOR ART
FIG. 1 is a prespective view of a prior art pin array corona generating device.

Moving now to FIG. 1, there is shown a known configuration for a pin array corona generating device of the type that is commonly used in an electrophotographic reproducing apparatus as described hereinabove, for example as the charging device 20 located at charging station A. It will be understood that the corona generating device of the present invention may also be used in a transfer, detack or cleaning subsystem since such subsystems may also utilize a corona generating device. The corona generating device of FIG. 1, generally identified by reference numeral 80 includes an electrode 81 having an array of needle-like pins 82 extending therefrom, with the electrode 81 being supported by means of a pair of elongated support members 84 extending along either side of the electrode 81, in contact therewith. As illustrated, the electrode 81 is positioned and supported within a shield support frame comprising side shield elements 86. It will be understood that the side shield elements 86 of the support frame are typically fabricated of a conductive material but may be fabricated of a non-conductive material for specific applications. The side support members 84 extend between end mounting blocks 87 and 88 for supporting the electrode between two side shield elements. The side support members 84 comprise elongated members disposed on either side of pin array electrode 81 such that the electrode 81 is sandwiched therebetween. In a typical embodiment, the pin array electrode 81 is attached in some fixed manner, to side support members 84 which, in turn, are fixedly mounted into support slots (not shown) in each end mounting block 87 and 88. A central support element 83, adapted to receive the pin electrode 81/side support member 84 combination, is also provided for being mounted to side shield member 86 so as to add structural integrity to the pin array electrode 81, as well as the corona generating device 80, as a whole.

Pin array electrode 81 preferably comprises a thin, elongate member fabricated from a highly conductive material having an array of integral projections such as pins including triangular teeth or scalloped edges along one edge thereof and extending along the entire length of an edge of the elongate electrode member so as to extend in a direction towards a surface to be charged (not shown). Pin array electrode 81 may be coupled to a high-voltage extension member 85, or may be provided with an integral high voltage extension member for permitting electrical connection of the pin electrode 81 to a high-voltage power source (not shown). The pin array electrode 81 has a length approximately equal to the width of the surface to be charged, and a height sufficient to expose the teeth thereof when mounted between the side support members 84, which is required to provide proper charging characteristics. In a preferred embodiment, the pin array electrode 81 has a thickness of approximately 0.08 mm (0.03 inches) and the teeth of pin array 82 extend approximately 3.5 mm (0.136 inches) from the top edge of the side support member 84 at a pin tip-to-pin tip interval of approximately 3 mm (0.12 inches). It will be understood that, although the present invention is described with reference to a pin array electrode in a corona generating device, the features of the present invention described in further detail hereinbelow could be adapted for use in conjunction with various devices and other configurations outside of the realm of corona generating devices in general.

Figure 2:
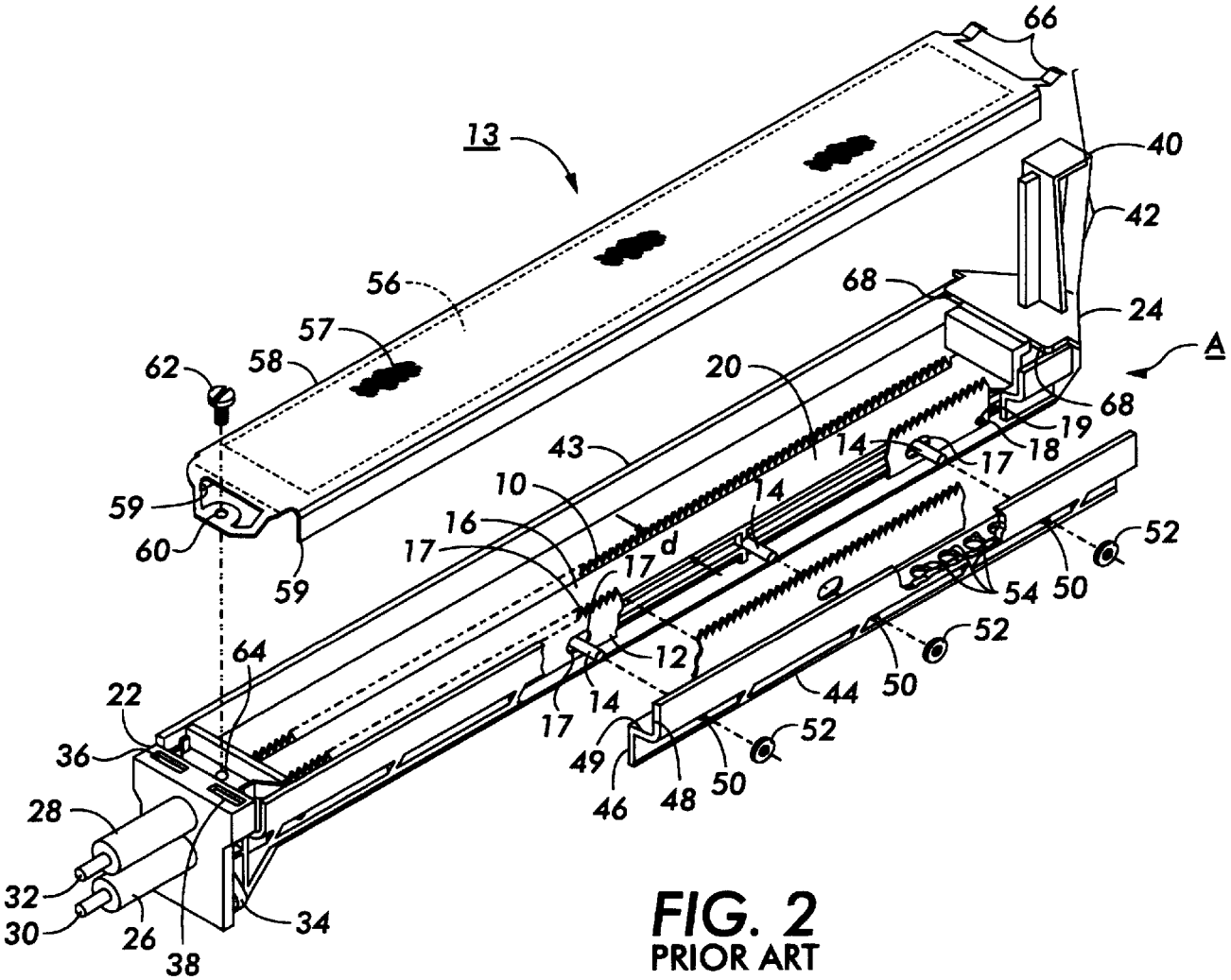
FIG. 2 PRIOR ART
FIG. 2 is a exploded perspective view showing a prior art support assembly for a pin array type corona rating device.

Referring now to FIG. 2, another prior art corona generating device is shown, characterized by two saw tooth pin array corona generating electrodes 11 and 13, and a control screen or grid 23 for being disposed between the pin array electrodes 11, 13 and the surface to be charged (not shown). As illustrated, the electrodes 11, 13 may be supported on support projections 15 and locator pin members 18, extending outwardly at generally corresponding positions on opposite sides of a central insulative support member 16. Central support member 16 maintains the electrode members 11 and 13 spaced a distance d apart. The distance d is chosen to be as large as possible, consistent with the need for a compact device, as smaller d spacings require greater power levels to drive the particular corona generating device at ion producing levels.

Support projections 15 extend through electrode support openings 17, spaced along the pin array electrodes 11 and 13. Support openings 17 are slightly larger than the support projections 15 to allow a loose fit for adjustment in placement of the electrode members with respect to the corona generating device. Support projections 15 and locator pin member 18 are provided on support member 16 to correctly position pin array electrode 11 with respect thereto, while another locator pin member (not shown) is located at a slightly offset position on the opposite side of central support member 16 to position the otherwise generally identical pin array electrode 13 in an offset position with respect to pin array electrode 11. The locator pin members extend through a locator pin opening 19 on each pin array electrode and tightly fitting over the locator pin member to firmly position the electrodes. The pin array electrodes 11, 13, and the arrangement for supporting them with respect to the photoconductive surface, has equal applicability, for example, to corona generating devices including single or multiple electrodes or discrete pins in an array. Likewise, other support arrangements for accommodating the support of the corona generating electrodes 11, 13 are contemplated for use with respect to the present invention.

Central support member 16 is provided with an electrode support portion 21 and mounting block members 22 and 24 on either end thereof. Support projections 15 extend outwardly from electrode support portion 21, on either side thereof, in opposing directions. Mounting block 22 integrally supports contact support portions 26 and 28, each respectively supporting a high voltage contact member 31, for coupling the pin array electrodes 11 and 13 to a high voltage source (not shown), and a low voltage contact member 33 for coupling control screen 23 to a low voltage source (not shown). Mounting block 22 also includes a locking spring member 35 which engages with receiving members (not shown) extending through locking spring slots 37 and 38 for mounting the corona generating device in an electrophotographic machine. Mounting block 24, located opposite mounting block 22, supports an extension member 41 for insertion into a receiving slot (not shown) used to mount the device into the electrophotographic machine and to correctly position the device with respect to the assembly. A locking member 43, suitable for engagement with a spring biased locking member (not shown) on the electrophotographic machine assembly, locks the device into position therein.

Side support members 45 and 47 are generally identical members, advantageously provided with a stepped cross section having first and second vertical portions 46 and 48 joined by a horizontal portion 49. First vertical portion 46 is provided with support projection receiving openings 51 corresponding to support projections 15. Pin array electrodes 11 and 13 are each supported by support projections 15, between central support member 16 and one of the side support members 45 and 47. The electrodes 11, 13, side support members 45, 47 and central support member 16 are fixed into position with fasteners 52, fastened over support projections 15, and against side support members 45 and 47, to hold the assembly together. In the prior art embodiment illustrated in FIG. 2, fasteners 52 are provided in the form of a self-locking spring steel snap nut commonly known as a "Tinnerman nut" which typically comprises a plurality of resilient leaf members for gripping support projection shaft 15 in a manner so as to urge together elements fastened thereby, while resisting movement in the opposite direction. Alternatively, the structure can be held together by hot staking the support projections or by other means known for securing rods and studs in a mechanical structure for providing similar support integrity. The present invention is directed toward a novel fastening system for holding together the corona generating device of the type shown in FIG. 2 and will be described in greater detail following the instant description of the corona generating device.

Continuing now with the description of the elements making up the corona generating device, it will be seen from FIG. 2 that one or both of side supports 45 and 47 may advantageously be provided with an opening or an array of openings 54 along horizontal portion 49 to aid in the removal of possibly damaging corona byproducts from the area between the corona generating electrodes and the surface to be charged. Openings 54 additionally serve to aid in the prevention of arcing from the electrodes along the surfaces of side supports 45 and 47 toward screen 23. Control screen 23 typically comprises an elongated member having a generally U-shaped cross section including a frame portion 58 and a planar portion 56 making up a grid 57 having approximately a 40–70% open area. The upper limit of the grid open area is determined by mechanical properties of strength and desired current efficiency, while the lower grid open area limit is determined by the required efficiency in operation of the corona generating device. Parallel flange portions 59 extend perpendicularly from planar portion 57 along the elongated edges thereof, which fit inside second vertical portion 48 on side support members 45 and 47 for maintaining screen 23 in position with respect to the corona generating electrodes 11, 13. Screen 23 is supported at either end on mounting blocks 22 and 24. The screen 23 may advantageously be provided with a fastener receiving opening 60 disposed at one end of the screen 23 for receiving a conductive fastener member 62, inserted through an opening 64 in mounting block 22 to contact low voltage potential contact member 32. Spring tongue members 66, arranged at an end of the screen opposite to the fastener opening 60 are insertable into receiving openings 68 in mounting block member 24.

Moving now to the details of the support mounting provided by the present invention, it is noted that it is desirable, from time to time, to access the pin electrodes 11 and 13 from the corona generating device for the purpose of cleaning and/or replacement thereof. However, it has been found that the prior art assembly of FIG. 2 does not easily facilitate such access to the pin electrodes, and generally leads to breakage of the support projections when attempting to remove the fasteners 52 therefrom, resulting in destruction and disposal of the entire corona generating assembly. The present invention provides a support mounting for supporting a corona generating electrode in an assembly of the type similar to that shown in FIG. 2 in a manner that alleviates the problems noted above. As such, an arrangement is provided by the present invention for permitting easy access, removal and replacement of the electrode in a corona generating device or assembly.

Figure 3:
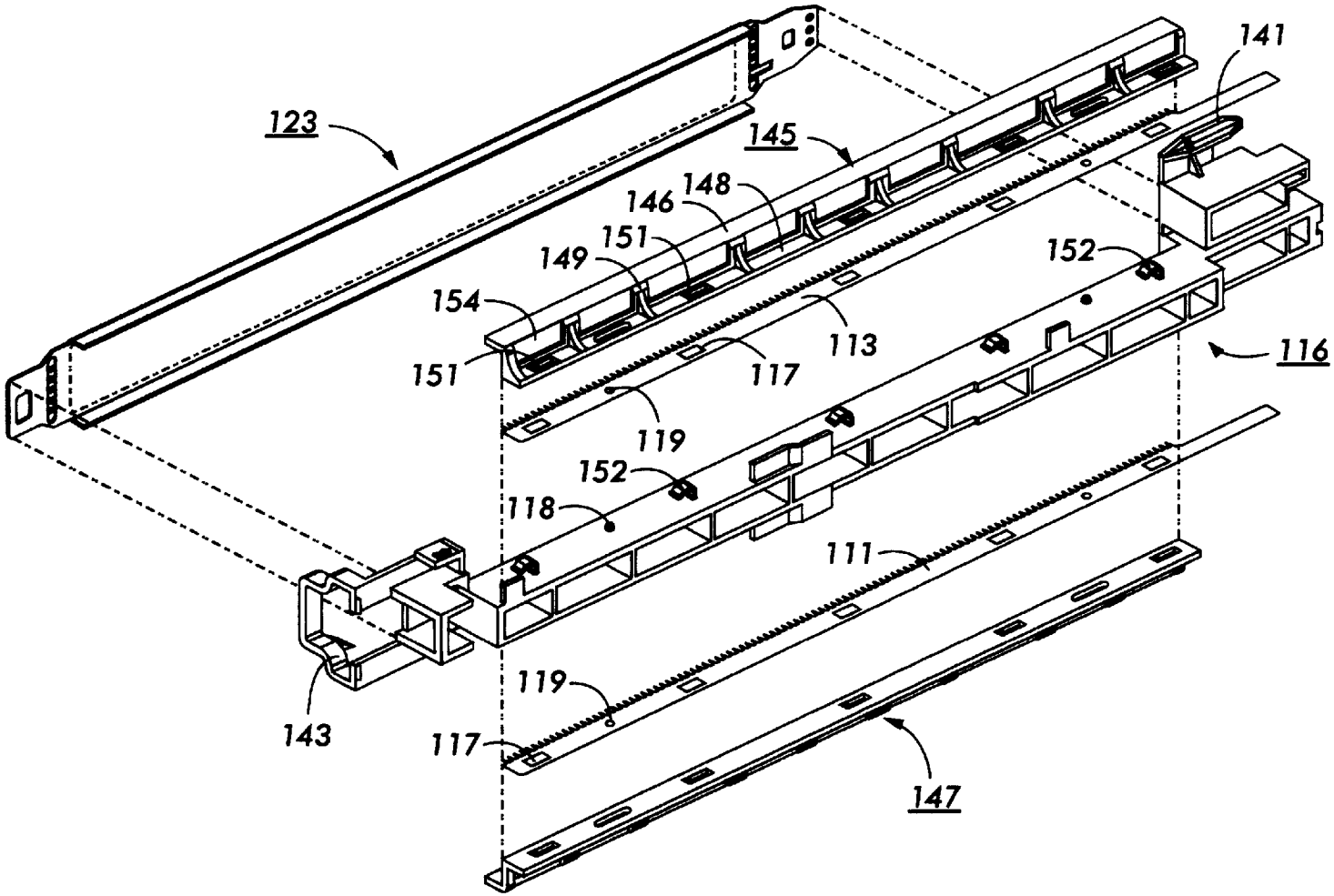
FIG. 3 is an exploded perspective view of the support mounting for a corona generating device in accordance with the present invention.

Referring now more particularly to FIG. 3, an exemplary embodiment of corona charging device incorporating the specific features of the present invention is illustrated and will be described in greater detail. The primary components of the corona charging device are similar to the components making up the corona generating device of FIG. 2, characterized by a pair of saw tooth pin array corona generating electrodes 111 and 113, a central, or primary support member 116, a pair of substantially similar side, or secondary, support members 145 and 147, and a control screen or grid 123. The central support member 116 also includes an alignment finger 141 for facilitating the proper positioning of the corona generating assembly in the electrostatographic printing machine. The pair of substantially similar side support members 145 and 147, is advantageously provided with a stepped cross section having first and second vertical portions 146 and 148 joined by a horizontal portion 149. One or both of side supports 145 and 147 may be adapted to define an opening or an array of openings 154 along horizontal portion 149 for assisting in the removal of corona byproducts from the area between the corona generating electrodes and the surface to be charged, and to aid in the prevention of arcing from the electrodes along the surfaces of side supports 145 and 147 toward screen 123.

With respect to the assembly of the present invention, the central support member 116 is provided with integral support projections 152 as well as locator pin members 118, extending outwardly, at generally corresponding positions, on opposite sides of the body of central support member 116. Correspondingly, electrodes 111, 113 are provided with support apertures 117 and locator apertures 119 such that the electrodes can be positioned on opposite sides of the body of central support member 116 with the support projections 152 extending through support apertures 117, and the locator pin members 118 extending through locator apertures 119 spaced along the pin array electrodes 111 and 113. Preferably, the support apertures 117 and the locator apertures 119 are provided with a dimension that is slightly larger than the respective support projections 152 and locator pin members 118 for permitting adjustment in the placement of the electrode members within the corona generating device.

In addition to the cooperative engagement of each electrode member 111 and 113 with the central support member 116, as facilitated by the alignment of support projections 152 and locator pins 118 with support apertures 117 and locator apertures 119, respectively, each side support member 145 and 147 is also provided with support projection receiving apertures 151, positioned so as to correspond to support projections 152, for cooperative engagement therewith. Thus, each pin array electrode 111 and 113 is sandwiched between the central support member 116 and one of the side support members 145 and 147 such that the electrodes 111, 113, side support members 145, 147, and central support member 116 are supported as a fixed assembly.

Figure 4:
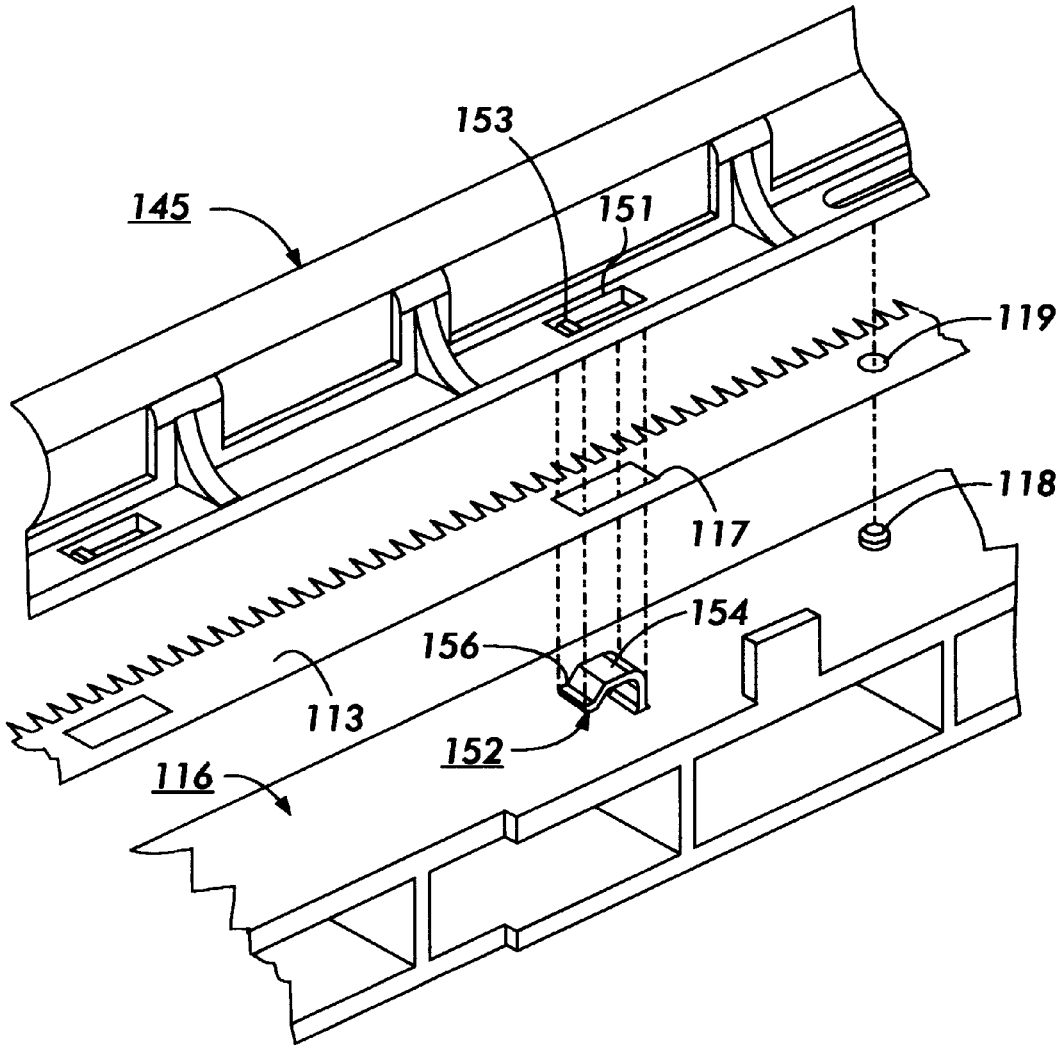
FIG. 4 is a blown up illustration showing a portion of the exploded perspective view of FIG. 3, providing greater detail of the support mounting in accordance with the present invention

In an important feature of the present invention, each support projection 152 is adapted to provide interlocking engagement with support projection receiving apertures 151. To that end, in a preferred embodiment as can be seen from the detailed illustration of FIG. 4, each support projection 152 includes a hook shaped body 154 for extending over an edge of each support projection receiving aperture 151, in contact therewith. The hook shaped body 154 of support projection 152 may be further provided with an extension finger 156 extending toward the body of the central support member 116, while support projection receiving apertures 151 may be further provided with a recess portion 153 for receiving the extension finger 156 of support projection 152 for generating enhanced interlocking engagement therebetween. In this preferred embodiment, the support projections 152 are preferably fabricated from a high strength, resilient moldable material such as a polyvinyl fluoride for facilitating disengagement between the support projection 152 and the support projection receiving aperture 151. It will be understood that numerous variations to the described embodiments of the present invention may be contemplated by the present invention in accordance with the broad scope of the claims provided herein.

In review, it should be clear from the foregoing discussion that the present invention provides a support mounting for supporting a corona generating electrode of a corona generating assembly, wherein a corona generating electrode member having an elongated length and defining a plurality of support openings spaced along the length thereof is sandwiched between cooperatively interlocking primary and secondary support members. The primary support member includes integral, outwardly extending support projections for supporting the corona generating electrode member, with the integral support projections arranged on the primary support member at positions corresponding to the support openings formed in the corona generating electrode member, and the secondary support member is adapted to define support projection receiving openings corresponding to the support projections of the primary support member for interlocking engagement therewith. The novel mounting and support system maintains the electrode in a fixed condition and allows for onsite replacement of the electrode rather than replacement of the entire corona generating device and assembly. It is noted that the support mounting of the present invention also provides a relatively easy means for removal and replacement of the pin array electrode from the corona generating apparatus in order to, for example, replace the pin array electrode.

It is, therefore, apparent that there has been provided, in accordance with the present invention, a corona generating device and mounting system therefor that fully satisfies the aims and advantages set forth hereinabove. While the present invention has been described with respect to a specific embodiment thereof, it will be evident to those skilled in the art that many alternatives, modifications and variations are possible for achieving the desired results. Accordingly, the present invention is intended to embrace all such alternatives, modifications, and variations which may fall within the spirit and scope of the following claims.

We claim:

1. A corona generating assembly, comprising: at least one corona generating electrode member having an elongated length defining a plurality of support openings formed therein, and spaced along the length of said corona generating electrode member;

a primary support member having integral support projections extending outwardly therefrom for supporting said at least one corona generating electrode member, wherein the integral support projections are arranged on said primary support member at positions corresponding to the support openings formed in said at least one corona generating electrode member for cooperative engagement therewith; and at least one secondary support member adapted to define support projection receiving openings corresponding to the support projections of said primary support member for interlocking engagement therewith, such that said at least one corona generating electrode member is sandwiched between said primary support member and said at least one secondary support member;

wherein the integral support projections each include a hook shaped body for extending over an edge of each support protection receiving aperture to provide interlocking engagement between said primary support member and said at least one secondary support member.

2. The corona generating assembly of claim 1, wherein said at least one corona generating electrode member includes an elongated conductive strip having an array of integral projections extending therefrom.

3. The corona generating assembly of claim 1, wherein said at least one corona generating electrode member further defines at least one locator aperture formed therein; and said primary support member includes at least one integral locator pin member extending outwardly therefrom for being received by the at least one locator aperture for to align said at least one corona generating electrode member between said primary support member and said at least one secondary support member.

4. The corona generating assembly of claim 1, further including a screen member supported on the said at least one secondary support member in a plane substantially perpendicular to the elongated length of said at least one corona generating electrode member.

5. The corona generating assembly of claim 1, wherein the hook shaped body of the integral support projection includes an extension finger; and the support projection receiving apertures include a recess portion for receiving the extension finger of the support projection for providing enhanced interlocking engagement therebetween.

6. The corona generating assembly of claim 1, wherein the integral support projections are fabricated from a high strength, resilient moldable for facilitating engagement and disengagement between the support projection and the support projection receiving aperture.

7. An electrostatographic printing apparatus including a corona generating assembly, comprising:

at least one corona generating electrode member having an elongated length defining a plurality of support openings formed therein, and spaced along the length of said corona generating electrode member;

a primary support member having integral support projections extending outwardly therefrom for supporting said at least one corona generating electrode member, wherein the integral support projections are arranged on said primary support member at positions corresponding to the support openings formed in said at least one corona generating electrode member for cooperative engagement therewith; and at least one secondary support member adapted to define support projection receiving openings corresponding to the support projections of said primary support member for interlocking engagement therewith, such that said at least one corona generating electrode member is sandwiched between said primary support member and said at least one secondary support member;

wherein the integral support projections each include a hook shaped body for extending over an edge of each support protection receiving aperture to provide interlocking engagement between said primary support member and said at least one secondary support member.

8. The electrostatographic printing apparatus of claim 7, wherein said corona generating electrode member includes an elongated conductive strip having an array of integral projections extending therefrom.

9. The electrostatographic printing apparatus of claim 7, wherein said at least one corona generating electrode member further defines at least one locator aperture formed therein; and said primary support member includes at least one integral locator pin member extending outwardly therefrom for being received by the at least one locator aperture to align said at least one corona generating electrode member between said primary support member and said at least one secondary support member.

10. The electrostatographic printing apparatus of claim 7, further including a screen member supported on the said secondary support member in a plane substantially perpendicular to the elongated length of the at least one corona generating electrode member.

11. The electrostatographic printing apparatus of claim 7, wherein the hook shaped body of the integral support projection include an extension finger; and the support projection receiving apertures include a recess portion for receiving the extension finger of the support projection for providing enhanced interlocking engagement therebetween.

12. The electrostatographic printing apparatus of claim 7, wherein the integral support projections are fabricated from a high strength, resilient moldable for facilitating engagement and disengagement between the support projection and the support projection receiving aperture.

* * * * *